United States Patent [19]

Sánchez González

[11] Patent Number: 4,885,447

[45] Date of Patent: Dec. 5, 1989

[54] SYSTEM FOR THE INDUCTION HEATING OF THE ELECTRIC PLATES OF A COOKER

[75] Inventor: Juan Sánchez González, Zaragoza, Spain

[73] Assignee: Balay, S.A., Zaragoza, Spain

[21] Appl. No.: 821,061

[22] Filed: Jan. 21, 1986

[30] Foreign Application Priority Data

Jan. 23, 1985 [ES] Spain ..... 539790
Jan. 16, 1986 [ES] Spain ..... 550970

[51] Int. Cl.[4] ..... H05B 6/08

[52] U.S. Cl. ..... 219/10.77; 219/10.491; 363/98; 363/132

[58] Field of Search ..... 219/10.77, 10.75, 10.49 R; 363/132, 133, 134, 98, 17

[56] References Cited

U.S. PATENT DOCUMENTS 3,506,907 4/1970 Porterfield et al. ..... 219/10.77 X
4,356,371 10/1982 Kiuchi et al. ..... 219/10.77
4,426,564 1/1984 Steigerwald et al. ..... 219/10.77
4,453,068 6/1984 Tucker et al. ..... 219/10.77
4,456,807 6/1984 Ogino et al. ..... 219/10.77
4,473,732 9/1984 Payne ..... 219/10.77
4,475,149 10/1984 Gallios ..... 363/17
4,540,866 9/1985 Okuda ..... 219/10.77
4,555,608 11/1985 Mizukawa et al. ..... 219/10.77

FOREIGN PATENT DOCUMENTS 3415967 11/1984 Fed. Rep. of Germany ... 219/10.77

*Primary Examiner*—Philip H. Leung
*Attorney, Agent, or Firm*—Ladas & Parry

[57] ABSTRACT

An inverter bridge of MOS technology transistors applies a series of high frequency power pulses to a disc coil in an electrically-heating of a cooker plate in order to heat a ferromagnetic container on the plate. The transistorized inverter bridge is activated by a control circuit which adjusts the triggering moment of each leg of the transistor bridge to the inductive recovery times of the disc coil and inhibits the functioning thereof in the absence of ferromagnetic load, i.e. container, on the plate. In this manner, the plate is self-igniting when a ferromagnetic container is placed thereon, thereby substantially reducing the electric power consumed in use. The control circuit for activating the transistor bridge is advantageously incorporated in a single integrated circuit in order to reduce maximumly the wiring and cost of assembly.

15 Claims, 3 Drawing Sheets

SYSTEM FOR THE INDUCTION HEATING OF THE ELECTRIC PLATES OF A COOKER

The present invention refers to a system for induction heating from an electric plate of a cooker. The system is based on electronic circuits for electrically feeding a high frequency pulsating current to a hot or heating electric-indication coil-plate of the type employed in electric cookers.

SUMMARY OF THE INVENTION

The invention refers to a system for induction heating from an electric plate of a cooker which is basically comprised of a disc coil integrated in the plate for induction heating by applying a series of high frequency power pulses. The pulses are applied to the coil through an inverter bridge consisting of four MOS power transistors, topologically arranged in respective diagonal legs an H-shaped bridge circuit.

Said transistor inverter bridge serves as a double current breaker between the terminals of the said disc coil and of the corresponding terminals of a direct current power supply. That is to say, one pair of the transistors , as one switching stage, switches with the positive pole of the power supply whereas the other pair of the transistors, as another switching stage, switches with the negative pole of the power supply, thereby applying the power to alternate terminals of the bridge.

Even though, the respective pairs of the transistors of the bridge are relieved of the switching function alternately it is absolutely impossible for both pairs of the transistors of the bridge to switch simultaneously, due to a control and trigger circuit for the transistor bridge.

The current applied to the disc coil is a rectangular voltage wave pulsating current, the pulse width of which is adjusted by the control circuit, depending on various monitoring parameters, so that the power applied to the coil is adjusted. The operating frequency of this pulsating current is higher than 20 KHz, thereby preventing any type of sound resonance due to mechanical vibrations of the coil.

The described system presents the characteristic that electric power is not dissipated if a ferromagnetic container or body is not placed on the hot plate. This is a rather important characteristic for the user of the electric cooker, since in the absence of a container, which should necessarily be ferromagnetic, to be heated, the plate cannot consume power.

It must be emphasised that in the design of the system of the present invention, the use of thyristors has been discarded due to the relatively high switching times, which would not enable switching at frequencies higher than 20 KHz, as occurs in the system of the invention.

Further, due to the intrinsic functioning of thyristors, the presence of highly complicated circuits would also be necessary to block each thyristor at the end of its conduction period, which would highly complicate the design and physical implantation of the finished device.

These disadvantages have been overcome with the selection and utilisation of modern MOS power transistors, which, apart from offering very short switching times, require a minimum energy for the triggering thereof and, due to their internal constitution, offer characteristics which are utilised in the realisation of the present invention.

In fact, the design of an inverter bridge for feeding an inductive load, must take into account the recovery interval of the energy stored in the coil or induction, after each conduction period of the respective legs of the inverter bridge, in such a manner that said energy is recovered before the opposite leg of the bridge starts conducting.

Therefore, the establishment of circuital paths for the recovery of the said inductive energy must be insured, since otherwise the known overvoltage peaks, which have destructive effects on the transistors constituting the inverter bridge, would be produced.

Thus, the invention employs the inverter diodes integrated in the MOS power transistors, in order to proportion an unloading side for the inductive energy stored in the coil. To this end, a capacitor having a small capacity is parallel-connected to the electrodes of each of the MOS transistors of the inverter bridge, whereby the energy transition are idled, giving the internal diodes of these transistors time to conduct, the switching speed of which is relatively low.

As already indicated, the two legs of the transistor inverter bridge switch alternatively and it is not possible for both legs to act simultaneously. This monitoring function is performed by means of the control circuit of the inverter bridge, so that the trip gates of the transistors of each leg are connected to the output of a two-input AND logic gate.

One of these inputs of each of the two AND gates receives the signal directly through the variable width pulse generator or circuit which is comprised of a monomultivibrator. However, the other input of one of the AND gates is connected to the output Q of a bistable circuit, whereas the other input of the other AND gate is connected to the complementary output $\overline{Q}$ of the same bistable circuit.

It can therefore be understood that it will be impossible for both legs of the bridge to switch simultaneously.

Since an inductive coil is utilised as the hot plate, the system provides, as variable parameters for determining the optimum behaviour of the assembly, the recovery times of the inductive energy stored in the coil, times which can vary to a large extent depending mainly on the ferromagnetic load employed (container to be heated) and on the position thereof on the coil. In this manner, the performance of the transistor inverter bridge, which, in short, is the main element contributing to the heating of the coil, has been optimised by adapting the dynamic behaviour of the bridge to the variations in the times inherent in the inductive recovery periods of the coil, so that a new pulse for activating the bridge is initiated exactly when the inductive energy stored in the coil has been recovered, which energy has been stored by the activation of the bridge in a prior pulse. In this manner, the dead times in the operation of the inverter bridge are avoided.

This optimisation is carried out by means of a simple but novel circuit comprised of two ultra rapid conduction diodes, connected to both terminals of the inductive coil, said diodes being joined to a capacitor, as will subsequently be described.

There has also been provided a circuit for regulating the power to be dissipated in the hot plate, which circuit is effected by utilising the frequency itself of the electric supply network and by subjecting this frequency to a divider circuit, enabling 10 differentiated power levels to be selected. This divider circuit will act on a gate which controls, together with other parameters, the duration of the pulses generated by the monostable.

Another supplementary part of the system of the invention is comprised of a limiting circuit of the electric intensity circulating in the inverter bridge, which circuit consists of an inductive detector, preferably configured in the form of a toroidal coil wound onto a ferrite ring. This detector circuits act on a monostable circuit which, in turn, is connected to the eraser input of the pulse generating circuit.

In this manner, the induction heating system of the electric plates of a cooker is consolidated, which system utilises the switching of the magnetic field generated by the activation of the inverter bridge on the inductive coil, whereby a surface of ferromagnetic material close to said coil is heated. This coil will be a disc and will be comprised of a spiral conductor wire winding. The thermal effect is produced by the power losses due to the two types of inductive effects present: the hysteretic cycle of the material and the local type Foucault currents generated in the coil. As already indicated, the frequency at which the transistor inverter bridge ought to operate must be above 20 KHz, to prevent audible sound vibrations.

Therefore, a hot plate controlled by an inverter bridge comprised of four MOS power transistors and a highly simple, reduced control circuit is obtained, offering an assembly having elevated performance yields and operative security. The electric power handled by this system can reach 1,500 Watts and the power output in the thermal load is greater than 85%.

In accordance with a rather advantageous embodiment, the control circuit formed of the monostables, bistables, the AND gates and the feedback, is integrated in a single piece, that is, said control circuit is an integrated circuit by means of which an economic saving and a lesser occupation of space, as well as a substantial reduction in the wiring, are attained.

Further, when the system is provided with the said integral control circuit, this latter is controlled by a microprocessor, wherefore the power selector circuit is removed. Coupling between the microprocessor and the said integrated circuit is an octo-electronic coupling based on photo-transistors, by means of which the input and output signals of the microprocessor are adapted.

In this embodiment, the inverter bridge protecting circuit is provided with a transistor which performs the function of re-triggering.

SHORT DESCRIPTION OF THE DRAWINGS

FIG. 1 corresponds to a block diagram representing the functional structure of the system of the invention. From this diagram it can be seen that the system is consolidated by a central blocks which controls, through two AND logic gates, the transistor inverter bridge which applies electric power to the thermal effect producing inductive coil.

FIG. 2 represents a schematic diagram of the transistor bridge which switches the power applied to the coil. This figure illustrates the direct current supply constituting the power supply to the coil. The feedback circuit for the self-triggering of the system is also illustrated.

FIG. 3 represents the circuital organization of the system, illustrating the various parts integrating it and forming the various blocks shown in FIG. 1.

FIG. 4 also represents the circuital organization of the system according to an advantageous variant, illustrating how the entire control circuit is comprised of a single integrated circuit.

DETAILED DESCRIPTION OF THE INVENTION

Figure 1:
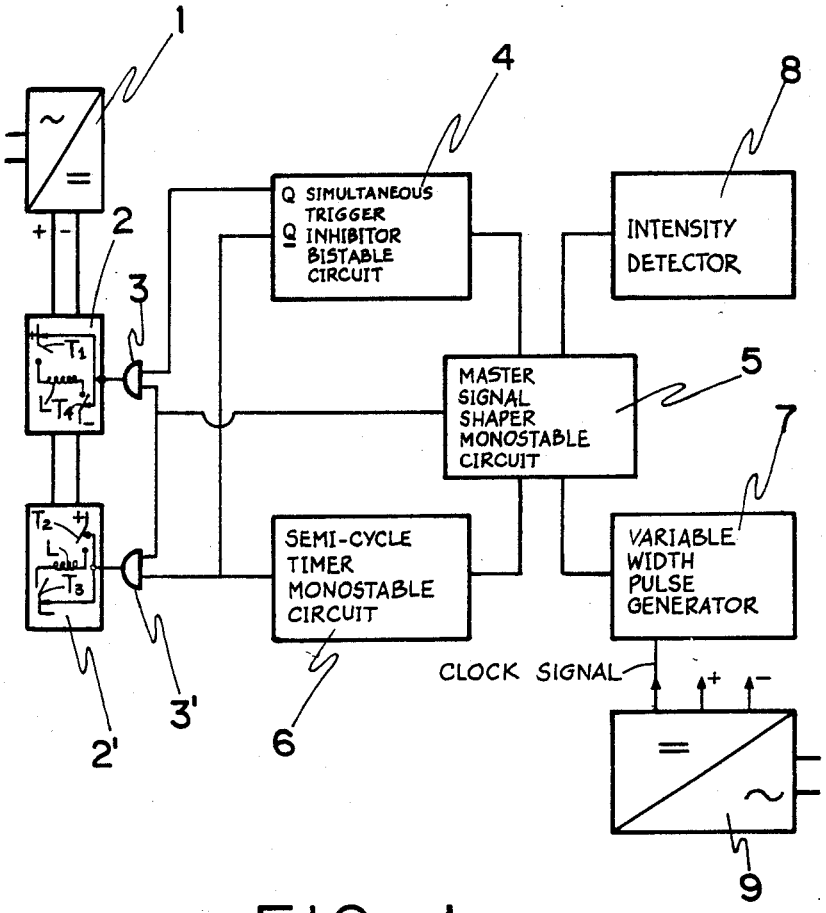

Referring to the drawings and more specifically to the block diagram of FIG. 1, the system for the induction heating of the electric plates of a cooker is comprised of a direct current supply 1 which applies its voltage to a coil L through switching stages 2,2'.

The coil L performs the function of a heat resistance and is advantageously comprised of a flat spiral winding of a simple conductor wire having a Teflon or similar insulation. Although in the block diagram of FIG. 1 the said coil is duplicated in the switching-stage blocks 2 and 2', in reality there is only one coil and blocks 2 and 2' determine a single switching unit, as will be apparent later on.

This switching unit 2 and 2' is controlled by a control circuit having-two AND logic gates 3 and 3' respectively connected to the stages 2, 2' of the switching unit. The function of these gates 3 and 3' is to prevent the blocks 2 and 2' from switching simultaneously. The function is obtained by having one of the inputs of each gate 3 and 3' connected to the outputs Q and $\overline{Q}$ respectively of a bistable circuit 4 which constitutes a "simultaneous trigger inhibitor" of the switching blocks 2 and 2'.

The conduction times of each of the switching blocks 2 and 2' are determined by the pulse width proportioned by the block 5 constituting a "master signal shaper", which is formed of a monostable circuit.

As illustrated in FIG. 1, the block 5 is controlled by three different blocks 6, 7 and 8.

The block 6 is a monostable circuit performing the function of "semi-cycle timer" which protects the inverter bridge and dynamically detects the presence of a ferromagnetic mass on the coil. Further, the block 7 is a "variable width pulse generator" by means of which the various levels of the power applied to the load or coil L can be selected.

Block 8 is the detector of the intensity which circulates in the switching blocks 2 and 2', protecting the entire system from overintensities.

The entire logic circuitry of this control assembly is electrically fed by the power supply 9 from which, furthermore, a clock signal is extracted, which is utilised by the block 7 as a reference signal.

Figure 2:
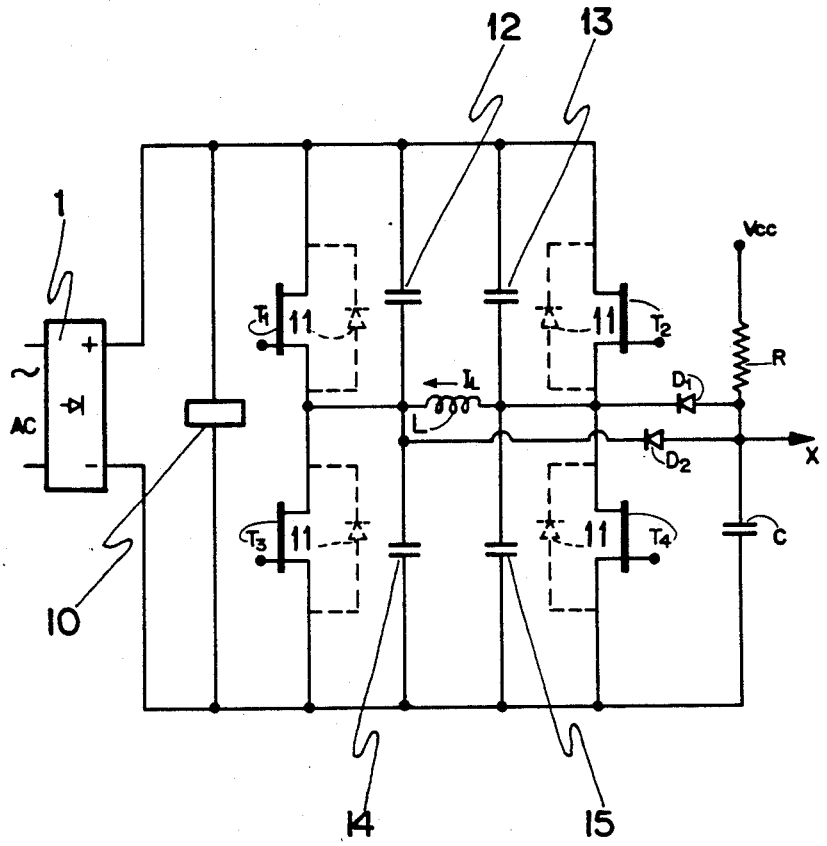

Referring to the circuital diagram illustrated in FIG. 2, it can be stated that it is specifically directed to the structure consolidating the switching blocks 2 and 2'.

As can be seen, the power extracted from a DC power supply 1 (completed with the filter condenser 10) is applied to the coil L which is in the center, between two diagonal legs of an H-shaped inverter bridge connected across the power supply. Each leg has a pair of MOS technology transistors T1, T4 and T2, T3 respectively at opposite ends of the coil for pulsed electric current conduction in opposite directions through the coil.

The pair of transistors T1 and T4 switch simultaneously, connecting the terminals (+), (−) of the power supply 1 to the respective terminals of the coil L. These two transistors T1 and T4 consolidate the switching block 2 illustrated in FIG. 1.

Further, the pair of transistors T2 and T3 consolidate the switching block 2', determining the other leg of the transistor bridge. Functioning of this leg of the bridge is similar to that of T1 and T4.

Conduction of the transistors T2 and T3 takes place alternatively in time with the conduction of T1 and T4, but their periods can never overlap.

Thus, it can be seen that the two legs of the switching bridge or transistor inverter bridge determine the H-configuration.

To insure circuital paths for the output of the residual inductive energy stored in the coil, so as to avoid the typical overvoltage peaks which will destroy the transistors of the inverter bridge, inverter diodes (represented with broken lines because integrated in the transistors T1 to T4) are utilized. These diodes, along with the capacitors 12 to 15, arranged parallel to the said transistors, insure the integrity of the inverter circuit and simultaneously enable the introduction of a feedback circuit which will control the self-adaptation of the trigger moments of the transistor bridge.

Since the system of the present invention utilises a disc coil L as the inductive hot plate, making it operate with a high frequency square wave signal (in the range of 20,000 KHz), the recovery times of the inductive energy stored in the coil must necessarily be varied to a large extent.

This variation will mainly depend on the ferromagnetic load placed on the coil (container to be heated), as well as on the position thereof on the coil.

Taking into account these details, the invention carries out the optimization of the performance of the transistor inverter bridge by adapting its dynamic behaviour to the variations in the inductive recovery times of the coil, so that a new conduction pulse of the inverter bridge is produced exactly at the moment at which the recovery of the inductive energy produced by the prior pulse, terminates. Thus, dead times in the operation of the inverter bridge are avoided.

To perform this task, a feedback circuit joining the transistor inverter bridge to the control circuit is employed.

FIG. 2 illustrates the said feedback which is comprised of two diodes D1 and D2. The cathodes of the diodes are connected to opposite-end terminals of the coil L, whereas its anodes are joined at the mid-point of a resistor-capacitor network RC.

Figure 3:
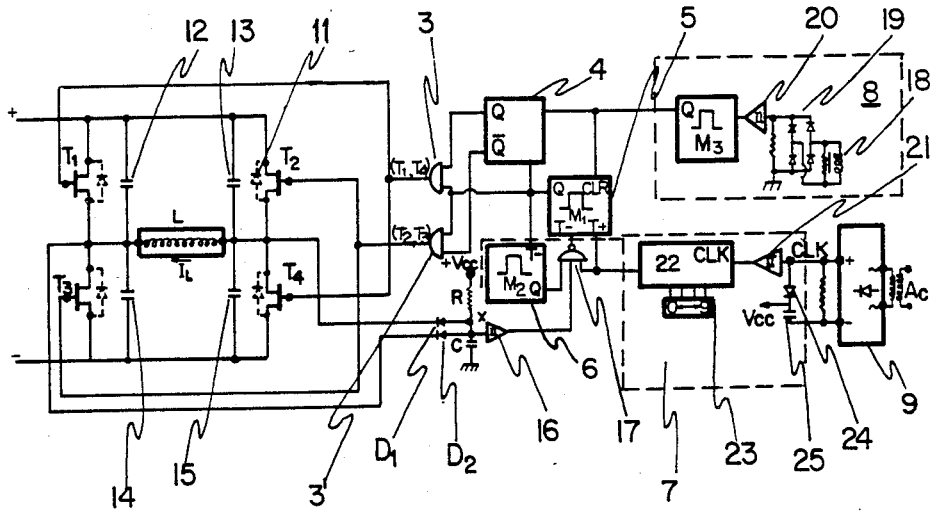

This feedback circuit is also illustrated in the diagram of FIG. 3, which will now be described.

In the assumption that the inverter bridge has already been triggered, the control circuit of the system effects the self-adaptation of the trigger moment of the new conduction pulse, detecting the end of inductive recovery by ultra rapid diodes D1 and D2 which initiate conduction when the corresponding internal diodes 11 of the transistors T1 to T4 conduct.

During each inductive recovery interval, one of these diodes maintains the capacitor C discharged, until the end of the conduction of the diode. From this moment onwards the said capacitor is rapidly charged through the resistor R, producing a control pulse which is duly conformed by the Schmitt Trigger circuit 16.

Further, it must be emphasised that the dynamic detection of the recovery of the inductive energy of the coil also enables the presence or not of the ferromagnetic mass on the coil to be discriminated. Thus, the hot plate will not effect any heating whilst there is no container or ferromagnetic material thereon, a characteristic which is rather practical for the domestic use of the system of this invention.

In the absence of ferromagnetic load on the coil L, the inductive recovery time will be considerably longer than when the ferromagnetic load is present, enabling a timer circuit to act, which causes the inverter bridge to be inoperative.

Thus, as can be observed in FIG. 3, there is provided a monostable timer circuit M2 which generates a pulse whose duration is slightly shorter than that of the inductive recovery of the insulated coil. This control pulse is applied to a NAND logic gate 17 to which the signal from the said feedback circuit is also applied. The output of this NAND gate 17 re-triggers the monostable circuit M1 which determines the said block 5 (master signal shaper).

The said monostable M1 or block 5 proportions the activation pulse for the pairs of transistors T1-T4 and T2-T3 of the inverter bridge. The said pulse is transmitted alternatively to one or the other of these pairs of transistors by activating the T-type bistable (referenced 4).

The bistable 4 changes status with each of the pulses of the M1.

To protect the power devices from overintensities, the resistor is provided with a protecting circuit 8.

One of the causes which could produce an overintensity could be motivated by proximity to the coil of a material having diamagnetic properties, for example the placing on the hot plate of an aluminium container.

In this case, the effective value of the selfinduction of the coil will diminish drastically, permitting intensity peaks with a much higher value than normal.

To avoid this situation, there is provided an inductive detector 18 in the form of a toroidal coil on a ferrite ring. This detector 18 is placed on the coil and provides a signal proportional at all times to the intensity Il circulating in the coil L. This signal, once rectified by the diode bridge 19, sets a limit value which coincides with the trigger threshold of the Schmitt trigger circuit 20, so that once this limit has been passed, a wide pulse monostable M3 is triggered, which activates the eraser inputs of the master monostable M1 and of the bistable 4, stopping operation of the inverter bridge and thus protecting the power transistors from being destroyed due to an over-intensity.

To complete the description of the circuitry illustrated in FIG. 3, we shall refer to the block 7.

The purpose of this block is to enable the user to effect an outer control of the power to be supplied by the inverter bridge to the hot plate.

The control takes place by a distribution of operative-inoperative intervals of the system, selectionable according to 10 levels. A signal from the frequency itself of the electric current of the network is taken as a reference signal for this distribution.

In fact, the power supply 9 proportions a continuous pulsating voltage, with a pulsating frequency double that of the network. In the case of alternating current network at 50 c/s, temporary intervals of 10 milliseconds can be defined.

These pulses of 100 c/s are conformed with a Schmitt trigger circuit 21 and are applied to a pulse counter-selector 22, of the rate-multiplier type which controls the N passage of each 10 pulses reaching it; N can be selected from 0 to 9 by means of a simple rotary switch 23.

Thus, by means of this simple circuit it is possible to control 9 stepped levels of thermal power in the hot plate.

By means of the diode 24 and the capacitor 25, the continuous voltage $+V_{cc}$ for feeding the entire previously described control logic, is obtained.

Therefore, the system for the induction heating of this invention, is configured from an inverter bridge comprised of four MOS technology power transistors controlled by a simple control circuit consisting of 5 blocks, offering elevated performance both with respect to energy outputs of the plate as well as to the safety of the functioning of the assembly.

Figure 4:
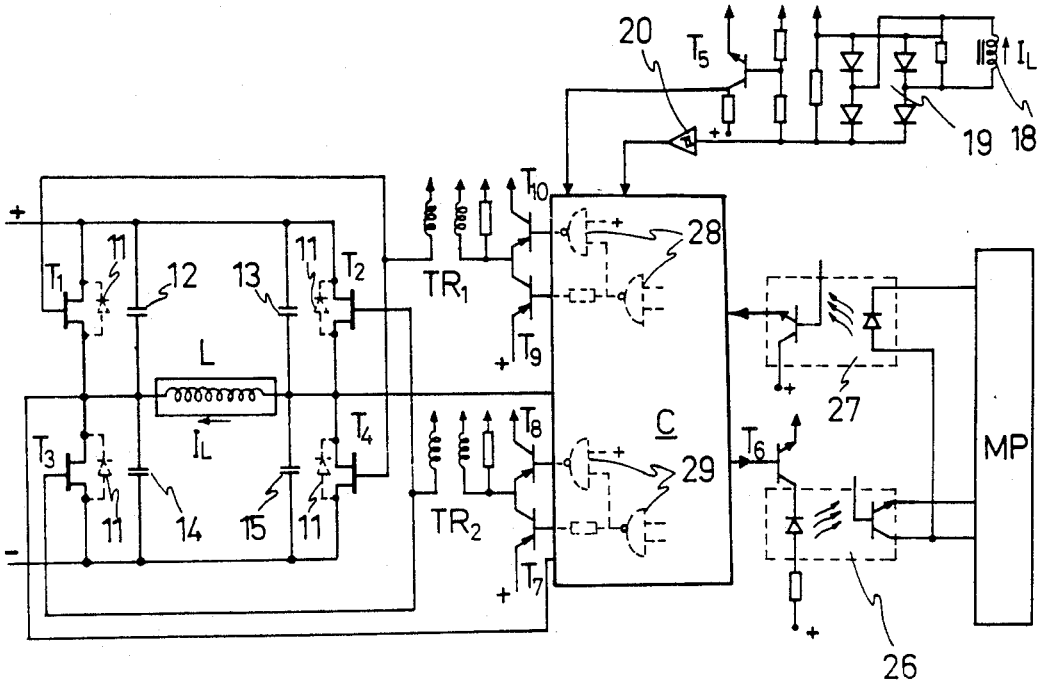

FIG. 4 illustrates another embodiment of the system in which the blocks constituting the control circuit are incorporated in a single integrated circuit C, which is controlled by a microprocessor MP whose coupling to the said integrated control circuit C takes place through photo-transistors 26 and 27, by means of which the corresponding signals entering and leaving the microprocessor can be adapted with respect to the said integrated control circuit C. The photo-transistor 26, constituting the adaptation means of the signals reaching the microprocessor MP, is joined to an excitation transistor T6, whereas the photo-transistor 27 is that which applies the adaptation signals sent by the microprocessor MP to the coil through, logically, the integrated control circuit C.

The said inverter bridge is joined to the integrated control circuit C through pairs of transistors T7–T8 and T9–T10, so that between them and the inverter bridge there are provided coupling transformers $TR_1$ and $TR_2$, but in this case, that is, in the embodiment being described, the AND gates shown in FIG. 3, have been replaced by the NAND gates 28 and 29, joined in pairs as illustrated with dotted lines inside the block constituting the integrated control circuit C.

Further, the over-intensity protecting circuit is completed with a transistor T5 for effecting the corresponding re-triggering.

In the embodiment and as a result of the inclusion of the microprocessor, the block 7 of FIG. 3 will be removed, since the selection of the various power levels applied to the load or coil L, will take place by the microprocessor MP.

I claim:

1. System for induction heating from an electric plate of a cooker, comprising:

a DC power supply;

an H-shaped inverter bridge having two diagonal legs connected across the power supply for electric current conduction through the bridge and a disc coil for the electric plate in the center between the legs, each leg having a pair of MOS transistors respectively at opposite ends of the coil for the electric current conduction in opposite directions through the coil, whereby to heat inductively a ferromagnetic load associated therewith;

a bistable circuit means activating alternate conduction of the pair of MOS transistors of each leg for pulses of the electric current conduction through the coil at a frequency higher than 20 kHz;

selector circuit means for varying the width of the pulses of the current through the coil, whereby to select the power of the inductive heating;

intensity limiting circuit means responsive to the intensity of the current of the pulses above a threshold for stopping the alternate conduction of the pair of transistors of each leg, whereby to protect the transistors; and inductive recovery means for recovery of inductive energy produced by the coil with each pulse of the current.

2. The system of claim 1, wherein the selector circuit means comprises means for producing a signal having the frequency of an electric current network connected to the power supply, means for doubling the frequency of the signal into a pulse signal, means for counting a selected number of the pulses of the pulse signal, means for selecting the number of pulses of the pulse signal counted, and means responsive to the counting of the selected number of pulses of the pulse signal for correspondingly proportioning the pulses of the electric current conduction through the coil.

3. The system of claim 1, and further comprising feedback means responsive to the recovery of the inductive energy produced in the coil by each pulse of the current for causing the bistable circuit means to activate the alternate conduction for one of the pulses.

4. The system of claim 3, wherein the feedback means comprises an RC network having a resistor and capacitor joined at a mid-point therebetween, two diodes having cathodes respectively connected to the opposite ends of the coil and anodes each connected to the mid-point of the RC network, and means responsive to the capacitor for controlling the activation of alternate conduction of the bistable circuit means.

5. The system of claim 1, wherein the bistable circuit means comprises a T-type bistable circuit and a master monostable circuit for activating it, the master monostable circuit also having an eraser input for inhibiting the activating thereby.

6. The system of claim 5, wherein the intensity limiting circuit means comprises a toroidal coil on a ferrite ring for providing a threshold signal proportional to the current intensity in the coil, a trigger circuit having a limit for responding when the threshold signal passes the limit and a second monostable circuit providing a long pulse to the eraser input of the master monostable circuit for the inhibiting thereof.

7. The system of claim 5, wherein the master monostable circuit and T-type bistable circuit are integrated circuit components, and further comprising a microprocessor for controlling the integrated circuit components, phototransistor means for coupling the integrated components and microprocessor, and a pair of PNP bipolar transistors drivingly connected to a coupling transformer between the bistable circuit means and each MOS transistor for the activating thereof thereby.

8. System for the induction heating of the electric plate of a cooker according to claim 7, characterized in that the intensity limiting circuit means is completed with a re-triggering transistor.

9. The system of claim 7, and further comprising a pair of NAND gates drivingly connected between each pair of PND transistors and the integrated circuit components.

10. The system of claim 5, and further comprising feedback means responsive to the recovery of the inductive energy produced in the coil by each pulse of the current for causing the bistable circuit means to activate the alternate conduction for one of the pulses.

11. The system of claim 10, wherein the feedback means comprises an RC network having a resistor and capacitor joined at a mid-point therebetween, two diodes having cathodes respectively connected to the opposite ends of the coil and anodes each connected to the mid-point of the RC network, and means responsive to the capacitor for controlling the activation of alternate conduction of the bistable circuit means.

12. The system of claim 11, wherein the selector circuit means comprises means for producing a signal having the frequency of an electric current network connected to the power supply, means for doubling the frequency of the signal into a pulse signal, means for counting a selected number of the pulses of the pulse signal, means for selecting the number of pulses of the pulse signal counted, and means responsive to the counting of the selected number of pulses of the pulse signal for correspondingly proportioning the pulses of the electric current conduction through the coil.

13. The system of claim 12, wherein the intensity limiting circuit means comprises a toroidal coil on a ferrite ring for providing a threshold signal proportional to the current intensity in the coil, a trigger circiut having a limit for responding when the threshold signal passes the limit and a second monostable circuit providing a long pulse to the eraser input of the master monostable circuit for the inhibiting thereof.

14. The system of claim 13, wherein the master monostable circuit and T-type bistable circuit are integrated circuit components, and further comprising a microprocessor for controlling the integrated circuit components, phototransistor means for coupling the integrated components and microprocessor, and a pair of PNP bipolar transistors drivingly connected to a coupling transformer between the bistable circuit means and each MOS transistor for the activating thereof thereby.

15. The system of claim 14, and further comprising a pair of NAND gates drivingly connected between each pair of PND transistors and the integrated circuit components.

* * * * *